United States Patent [19]

Trenchard

[11] Patent Number: 4,714,813

[45] Date of Patent: Dec. 22, 1987

[54] MIXER FOR USE WITH MICROWAVE OVEN

[76] Inventor: Paul M. Trenchard, 39 Penylan Road, Cardiff, CF2 5HZ, United Kingdom

[21] Appl. No.: 823,870

[22] PCT Filed: May 28, 1985

[86] PCT No.: PCT/GB85/00226

§ 371 Date: Jan. 10, 1986

§ 102(e) Date: Jan. 10, 1986

[87] PCT Pub. No.: WO85/05560

PCT Pub. Date:

[30] Foreign Application Priority Data

May 29, 1984 [GB] United Kingdom ..... 8413558
Oct. 5, 1984 [GB] United Kingdom ..... 8425174

[51] Int. Cl.[4] ..... H05B 6/78

[52] U.S. Cl. ..... 219/10.55 F; 219/10.55 E; 366/219; 99/421 HV; 99/DIG. 14

[58] Field of Search ..... 219/10.55 E, 10.55 F, 219/10.55 R, 10.55 M; 366/219, 209; 99/421 HV, 421 P, DIG. 14

[56] References Cited

U.S. PATENT DOCUMENTS

| | | | |
|---|---|---|---|
| 1,723,145 | 8/1929 | Fernald . | |
| 3,427,422 | 2/1969 | Muller . | |
| 3,462,575 | 8/1969 | Holaday | 219/10.55 R |
| 3,744,403 | 7/1973 | Castronuovo . | |
| 4,286,133 | 8/1981 | Ginset et al. | 219/10.55 F |
| 4,336,435 | 6/1982 | Kashyap et al. | 219/10.55 F |
| 4,446,779 | 5/1984 | Hubbard et al. | 366/219 X |
| 4,458,128 | 7/1984 | Chabinsky . | |
| 4,467,163 | 8/1984 | Pauly et al. | 219/10.55 F |
| 4,471,195 | 9/1984 | Ishii et al. . | |
| 4,503,307 | 3/1985 | Campbell et al. | 219/10.55 E |
| 4,571,474 | 2/1986 | Pomroy | 219/10.55 F |

FOREIGN PATENT DOCUMENTS

| | | |
|---|---|---|
| 0093091 | 11/1983 | European Pat. Off. . |
| 371505 | 6/1923 | Fed. Rep. of Germany . |
| 2418155 | 4/1974 | Fed. Rep. of Germany . |
| 2033771 | 5/1980 | United Kingdom . |
| 2071970 | 9/1981 | United Kingdom . |
| 2096909 | 10/1982 | United Kingdom . |

*Primary Examiner*—Philip H. Leung
*Attorney, Agent, or Firm*—Paul C. Flattery; Bradford R. L. Price

[57] ABSTRACT

A mixer, primarily for thawing frozen biological materials, is adapted to use the turntable mechanism of a microwave oven (33), a container (4, 30) being carried round by the turntable mechanism (34) and being simultaneously rotated about a transverse axis. In one version the container is a cylindrical drum (4) carried by a cradle (3) which replaces the turntable. A transmission (5) such as friction wheels (13, 14) or gears (17, 18; 20) between the drum and fixed structure (17; 19; 22) within the oven causes the drum to rotate about its axis as the cradle is turned. Alternatively, the container (30) is spherical and the turntable (34) tilts so that the container is biassed to one wall (35) of the oven. But rotation of the turntable causes it to co-operate with other walls (37, 38) and thereby generates a tumbling action.

11 Claims, 7 Drawing Figures

MIXER FOR USE WITH MICROWAVE OVEN

This invention relates to mixers. It is primarily intended for a mixer which can be inserted into a domestic microwave oven, for example to achieve uniform and controlled thawing of frozen material.

Current medical practice often involves the thawing of frozen biological materials, and microwave radiation is sometimes used to achieve this. When this is done using a domestic microwave oven, rotation of the materials being thawed is usually performed in the horizontal plane by way of a motor-driven plate at the base of the oven, or alternatively in the vertical plane by way of a side-pivoted side-driven cradle. Neither method optimises the uniformity of radiation exposure, although the vertical method does contribute a tumble-mix component, once thawing is initiated. Non-uniform exposure of some frozen biological materials to microwave radiation may lead to heat-denaturation of the same in the areas of maximum exposure. The present invention was developed in order to minimise this problem, using a domestic microwave oven with central base-plate motor drive to achieve simultaneous horizontal and vertical axis rotation of the materials to be thawed. This optimises the uniformity of exposure of materials to microwave radiation, and also provides simultaneous tumble-mixing of the materials.

According to one aspect of the present invention there is provided a mixer for use with a microwave oven having a turntable, comprising a closable container for receiving a charge of material to be mixed, and structure for fixing within the oven for co-operation with the container as the latter is carried around by the turntable rotating means, such co-operation being arranged to rotate the container about an axis transverse to that of the turntable.

In one preferred form the container is a generally cylindrical drum with its axis horizontal, journalled in a cradle which is carried round by the turntable rotating means. The co-operation may then be provided by a transmission between a member co-axial with the drum and an annular path traversed by that member. This transmission may include an intermediate wheel carried by the cradle and engaging said member and said path. The elements of the transmission may have frictional engagement or interengaging gear teeth.

The structure may include a base plate for resting on the floor of the oven, the cradle being carried by the plate and adapted for engagement by the turntable rotating means through an opening in the plate, the actual turntable having been removed. For stability and location, the cradle will conveniently have rolling means which run on the periphery of said opening, and the cradle may lie within that opening. The annular path may be provided by the base plate.

In an alternative construction, the container is spherical and the structure comprises surfaces on the interior walls of the oven for successive engagement by the sphere as it is carried around by the turntable, there being means for imparting a bias to the sphere so that there is a preferred surface of engagement, each surface when engaged by the sphere being capable of imparting a rolling motion thereto.

This bias is conveniently a tilt imparted to the turntable. The surface immediately upstream of the preferred surface in relation to the direction of rotation of the turntable will preferably be spaced from the axis of the turntable a distance equal to the radius of the container, while said preferred surface will be spaced from the axis of the turntable a distance greater than that radius.

According to another aspect of the present invention there is provided a method for mixing and heating material, comprising encasing the material in a container, placing the container in a microwave oven, the oven having a turntable, and operating the oven, the container being carried around by the turntable rotating means and, by engagement with static structure within the oven, being caused to rotate about an axis transverse to that of the turntable.

Generally the container and structure will comprise a mixer as defined above.

This mixer and method are particularly suited to the thawing of frozen biological material.

For a better understanding of the invention, some embodiments will now be described, by way of example, with reference to the accompanying drawings, in which.

The mixer has a square base plate 1 with a circular hole 2, and in use is set on the floor of a microwave oven (not shown) with the hole centred on the drive spindle of a turntable. The latter will have first been removed.

Figure 1:
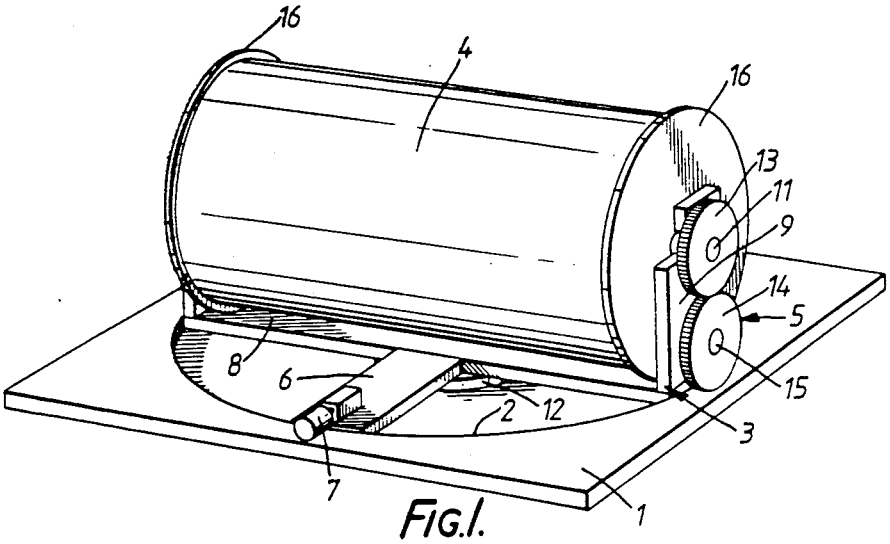
FIG. 1 is a diagrammatic perspective view of a drum mixer for use with a microwave oven equipped with a turntable.
Figure 2:
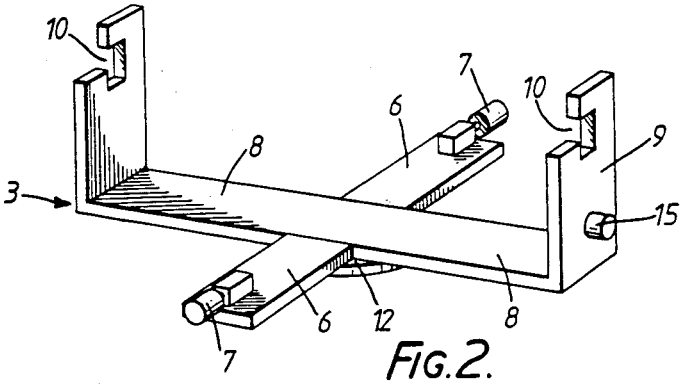
FIG. 2 is a perspective view of a drum support cradle forming part of the mixer, FIGS. 3(*a*) and 3(*b*) show alternative transmissions for generating rotation of the drum about its axis from the rotation of the turntable drive.

A cradle 3, most clearly shown in FIG. 2, sits in the hole 2 and is rotated by the turntable spindle. It carries a drum 4 with its axis horizontal, and the rotary motion of the cradle 3 is used by a transmission 5 to generate simultaneous rotation of the drum 4 about its axis.

The cradle 3 in plan view is in the shape of a cross with one opposed pair of arms 6 being equipped at its ends with rollers 7 which bear on the upper surface of the base plate 1. The other pair of opposed arms 8 have upstanding pillars 9 at their ends with L-shaped slots 10 to receive stub-shafts 11 at the ends of the drum 4. The shape of the slots 10 is such that the drum is mounted by being moved horizontally and then lowered to become captive.

Below the centre of the cross there is a boss 12 which is shaped underneath to be engaged by the upper end of the turntable spindle, and be rotated thereby, thus causing the cradle 3 and the drum 4 to turn about a vertical axis.

At one end of the drum, one of the shafts 11 is fitted with a friction wheel 13 which lies outside the pillar 9 when the drum is properly mounted, and this wheel 13 then engages another friction wheel 14 carried by a pin 15 lower down on the outside of the pillar 9. The wheel 14 bears on the base plate 1, and so as the cradle 3 is rotated, so the wheel 14 is turned. The frictional engagement with the wheel 13 causes the drum 4 to be rotated about its axis. Thus, the contents of the drum will be subject to a tumbling action as the drum is rotated about two mutually perpendicular axes.

Outside the pillar 9 at the opposite end from the transmission 5 (not visible in the Figure) there will be a roller similar to the rollers 7, so that the cradle will be stably supported at the ends of all the arms.

The drum has closed ends 16, each fitted centrally with one of the shafts 11. Access to the drum may be by removal of one or both of these ends 16, and conveniently they may have screw fitting to the basic cylinder. However, it will be understood that many other forms of attachment are possible, and a manual press-fit may be sufficient.

The inside of the drum may be equipped with blades or other means for accentuating the mixing action.

It is envisaged that virtually the entire mixer may be made from plastics material, and in certain circumstances where it is useful to know how the mixing is progressing the drum may be of clear plastics.

Figure 3:
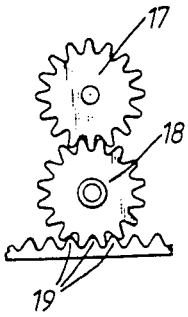
Figure 3:
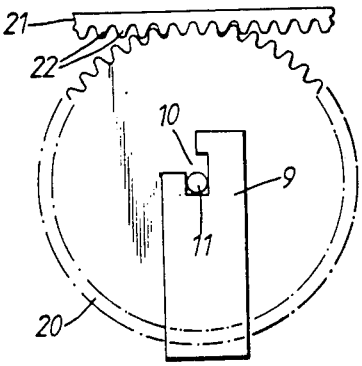

The transmission 5 may take various other forms, and two examples are shown in FIG. 3. In FIG. 3(*a*), gear wheels 17 and 18 replace the friction wheels 13 and 14, while the plate 1 is equipped around the periphery of the hole 2 with teeth 19 to provide positive engagement with the wheel 18. The rollers 7 will be arranged to run inside or outside the teeth 19.

In FIG. 3(*b*) there are no interengaging wheels; instead one end 20 of the drum is made larger than the other and formed with gear teeth around its periphery. Once the drum is mounted, a frame or plate 21 can be lowered to a fixed position overhead so that an annular array of teeth 22 on the underside of the member 21 is engaged by the wheel 20.

Figure 4:
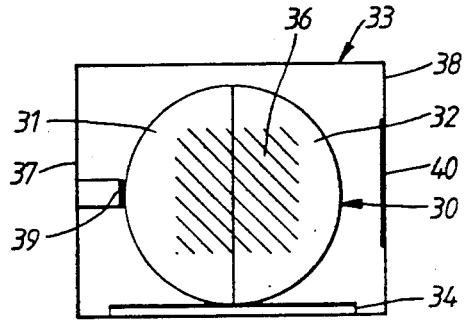
FIG. 4 is a diagrammatic front view of a microwave oven with a turntable and a spherical mixing vessel.
Figure 5:
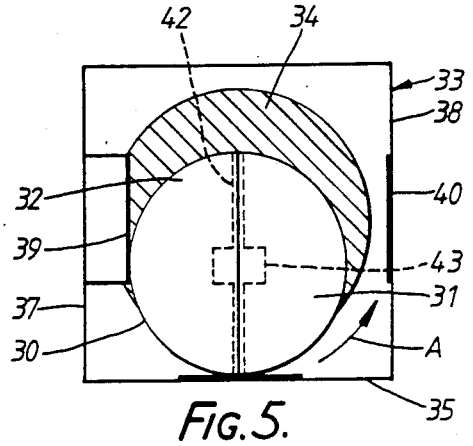
FIG. 5 is a diagrammatic plan view of the oven of FIG. 4.
Figure 6:
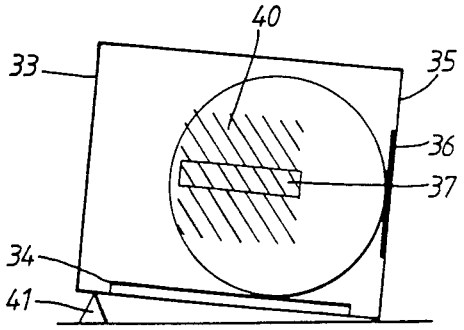
FIG. 6 is a diagrammatic side view of the oven of FIG. 4.

FIGS. 4 to 6 show an alternative mixer where the mixing vessel is a sphere 30 made by joining two substantially identical hemispheres 31 and 32. These can be screwed apart, for example, to load the charge to be mixed. The size of the sphere 30 will be related as described below to certain features of the interior of a microwave oven 33 in order to achieve the desired composite rotation.

The oven 33 has a turntable 34, but instead of being horizontal a tilt is imparted, as shown in FIG. 6, so that the sphere 30 which rests on the turntable will always tend to roll down towards the front wall 35, its point of contact with the turntable then being off-centre and down the slope. At the zone of contact with the wall 35, there is a friction pad 36 to promote rotation of the sphere as it is carried round by the turntable in the direction of arrow A. To keep the sphere in composite and random rotation, the side walls 37 and 38 are also provided with friction pads 39 and 40 respectively. That on the wall 37, which is upstream in relation to the front wall 35 and the direction of rotation of the turntable, projects into the oven so that the centre of the sphere cannot move nearer the pad 39 than the vertical fore and aft plane through the centre of the turntable. This prevents the sphere becoming stuck in the bottom left hand corner as viewed in FIG. 5. The opposite pad 40, however, on the side wall 38 is more remote and outside the radius of the turntable.

The tilt is shown as being imparted by a wedge 41 under the rear of the oven, but there may be more sophisticated arrangements, and an oven could be constructed where its main body would be set level but with its floor and turntable sloping. Also the slope need not be to the front.

It is important that the centre of gravity of the loaded sphere should be at its geometrical centre. Generally, the charge will be small in relation to the complete sphere, and one solution to this is to fit the two hemispheres 31 and 32 to opposite sides of a disc or "spider" 42, shown in broken lines in FIG. 5, at the centre of which there is a capsule 43 or other means of holding the material to be mixed.

The friction zones (including the surface of the turntable) are shown shaded when viewed face-on. They may be provided simply by adhesive tape, and in some ovens and with certain container surfaces, it may even be possible to dispense with such measures to enhance the friction.

This arrangement ensures that, as the turntable rotates, the tendency of the sphere to move with the turntable is partially counteracted by gravity and the friction between the sphere and oven walls. The interplay of forces leads to random rotation of the sphere provided that there is enough friction for the forces between the interacting surfaces to be effective to promote rolling, and yet to not such an extent as to prevent some degree of slippage.

While gravity is the simplest means of biassing the sphere towards one wall, it is possible that other means could be used. For example, a blower inside the oven could urge the sphere constantly in one direction, or magnetic attraction or repulsion could be employed.

I claim:

1. A mixer for use with a microwave oven, said mixer comprising an openable and closable, generally cylindrical drum and a cradle, said drum being journalled in said cradle, said cradle having means for engaging a turnatable drive spindle of a microwave oven to rotate therewith and to permit rotation of said drum with said drive spindle about an axis extending transversely through said drum as said drive spindle rotates said cradle, roller means carried on said cradle to rest on and to roll in a circular path on a stationary, flat surface as said drum and cradle are rotated by said drive spindle, and transmission means including at least some of said roller means for causing said drum to rotate about its own longitudinal axis as it rotates with said drive spindle.

2. The mixer of claim 1 in which said generally cylindrical drum is adapted to be positioned in a microwave oven with its axis perpendicular to the axis of the drive spindle of said microwave oven.

3. The mixer of claim 1 in which said tranmission also includes also at least one wheel attached to said drum in a generally coaxial relation to the longitudinal axis of said drum, said wheel being rotationally linked to said roller means of said transmission whereby, as said roller means rolls in its circular path on said flat surface, said wheel is rotated by said roller in a corresponding manner to rotate said cylindrical drum.

4. The mixer of claim 3 in which said wheel and said roller means of said transmission are linked together, and are adapted to be linked to said flat surface, in frictional engagement.

5. The mixer of claim 3 in which said wheel and said roller means of the transmission are circular gears with peripheral, interengaging teeth, and a circular gear track is provided on said flat surface for engagement by said roller means of the transmission as it is rotated in its circular path.

6. The mixer of claim 1 which includes a base plate for resting on the floor of a microwave oven, said cradle being carried by said base plate in rotational relation with said base plate, said base plate defining a central opening to permit connection of the cradle with a drive spindle of a microwave oven.

7. The mixer of claim 6 in which said cradle lies within the opening of said base plate, and said flat surface which the roller means of the transmission engages is defined by such base plate.

8. A mixer for use with a microwave oven, comprising an openable and closeable, generally cylindrical drum and a cradle, said drum being journalled in said cradle, said cradle having means for engaging a turntable drive spindle of a microwave oven to rotate therewith and to permit rotation of said drum with said drive spindle about an axis extending transversely through said drum as said drive spindle rotates said cradle, roller means carried on said cradle to rest on and to roll in a circular path on a stationary, flat surface as said drum and cradle are rotated by said drive spindle, and transmission means including at least some of said roller means for causing said drum to rotate about its own longitudinal axis as it rotates with said drive spindle, in which said transmission means also includes at least one wheel attached to said drum in a generally coaxial relation to the longitudinal axis of said drum, said wheel being rotationally linked to said roller means of said transmission whereby, as said roller means rolls in its circular path on said flat surface, said wheel is rotated by said roller in a corresponding manner to rotate said cylindrical drum, said mixer also including a base plate for resting on the floor of a microwave oven, said cradle being carried by said base plate in rotational relation with said base plate, said base plate defining a central opening to permit connection of the cradle with a drive spindle of a microwave oven, said base plate also defining the flat surface which the roller means of the transmission engages.

9. The mixer of claim 8 in which said generally cylindrical drum is adapted to be positioned in a microwave oven with its axis perpendicular to the axis of the drive spindle of said microwave oven.

10. The mixer of claim 9 in which said wheel and said roller means of said transmission are linked together, and to said base plate, in frictional engagement.

11. The mixer of claim 8 in which said wheel and said roller means for the transmission are circular gears with peripheral, interengaging teeth, and a circular gear track is provided on said base plate for engagement by said roller means of the transmission as it is rotated in its circular path.

* * * * *